US007434623B2

(12) United States Patent
von Gynz-Rekowski

(10) Patent No.: US 7,434,623 B2
(45) Date of Patent: Oct. 14, 2008

(54) PERCUSSION TOOL AND METHOD

(75) Inventor: Gunther HH von Gynz-Rekowski, Montgomery, TX (US)

(73) Assignee: Ashmin, LC, Montgomery, TX (US)

( * ) Notice: Subject to any disclaimer, the term of this patent is extended or adjusted under 35 U.S.C. 154(b) by 443 days.

(21) Appl. No.: 11/137,542

(22) Filed: May 25, 2005

(65) Prior Publication Data

US 2005/0211472 A1 Sep. 29, 2005

Related U.S. Application Data

(62) Division of application No. 10/371,373, filed on Feb. 19, 2003, now Pat. No. 7,011,156.

(51) Int. Cl.
*E21B 33/14* (2006.01)

(52) U.S. Cl. ..... 166/286; 166/177.4; 166/177.6

(58) Field of Classification Search ..... 166/286, 166/177.4, 177.6
See application file for complete search history.

(56) References Cited

U.S. PATENT DOCUMENTS

| | | | | |
|---|---|---|---|---|
| 1,654,833 | A | 1/1928 | Rice, Jr. | |
| 1,861,042 | A | 5/1932 | Zublin | |
| 1,934,252 | A | 11/1933 | Baker | |
| 2,755,069 | A | 7/1956 | Mosby | |
| 2,942,851 | A | 6/1960 | Beck | |
| 3,557,875 | A * | 1/1971 | Solum et al. | 166/286 |
| 3,815,692 | A | 6/1974 | Varley | |
| 3,946,819 | A | 3/1976 | Hipp | |
| 3,978,931 | A | 9/1976 | Sudnishnikov et al. | |
| 4,209,070 | A | 6/1980 | Sudnishnikov et al. | |
| 4,462,471 | A | 7/1984 | Hipp | |

(Continued)

OTHER PUBLICATIONS

H. D. Bui, J. A Meyers, Albert B. Yost II, "Introduction of Steerable Percussion Air Drilling System", SPE Int'l—Oct. 5-8, 1997 (5 pages), SPE 38582, SPE, San Antonio, Texas.

(Continued)

*Primary Examiner*—William P Neuder
(74) *Attorney, Agent, or Firm*—Robert L. Waddell; Ted M. Anthony

(57) ABSTRACT

A percussion apparatus and method of using the percussion apparatus. The apparatus may be used for delivering an impact to a tubular string. The apparatus comprises a cylindrical member having an internal bore containing an anvil and a first guide profile. The apparatus further includes a rotor disposed within the internal bore, and wherein the rotor member comprises a body having an outer circumference with a second guide profile thereon, and wherein the rotor contains a radial hammer face. In a first position, the second external guide profile of the rotor will engage with the first guide profile of the cylindrical member so that the radial hammer face can contact the anvil. In a second position, the second guide profile of the rotor will engage with the first guide profile of the cylindrical member so that the radial hammer face is separated from the anvil shoulder. Multiple rotors and multiple stators may be employed. The rotor may be operatively associated with a stator that directs flow into the rotor. The rotor may be comprised of a plurality of inclined blades. The percussion apparatus may be incorporated into a tubular string and used for multiple purposes within a well bore. For instance, a method of cementing a well with the percussion apparatus is disclosed.

11 Claims, 12 Drawing Sheets

U.S. PATENT DOCUMENTS

| | | | | | |
|---|---|---|---|---|---|
| 4,890,682 | A | | 1/1990 | Worral et al. | |
| 4,928,770 | A | | 5/1990 | Murray | |
| 4,958,690 | A | | 9/1990 | Cyphelly | |
| 4,958,691 | A | | 9/1990 | Hipp | |
| 5,029,642 | A | | 7/1991 | Crawford | |
| 5,152,342 | A | * | 10/1992 | Rankin et al. | 166/286 |
| 5,156,223 | A | | 10/1992 | Hipp | |
| 5,439,290 | A | * | 8/1995 | Wicks et al. | 366/241 |

OTHER PUBLICATIONS

Drilling: "High ROP Hammer Drill Sets Australian Records", Hart's Petroleum Engineer International, 13 pages, Issued Sep. 1996.

(Con't—Cite No. 10) CADE/CAODC Spring Drilling Conf.; Calgary, Alberta Can., Apr. 8-10, 1997, pp. 1-11, Issue Paper No. 97-137, CADE/CAODC, Calgary; Alberta, Can.

Suite of tools, including drag reducer developed for CT-drilled lateral wells; Increasing CT bit weight, Offshore, Apr. 2001, 153 pages.

Kevin McMillin, Engrg Editor, Fluid hammer tools improves directional steering performance; Reducing bit trips in difficult geology, Offshore, Nov. 1999, 53 pages.

AG-Itator Improves Downhole Weight Transfer, Feb. 2001, Andergauge Drilling Systems.

AG-Itator Clyde Petroleum Exploratie BV, Feb. 2001, Andergauge Drilling Systems.

Development History (SDS Digger Tools) www.sdscorp.com auDevhst.html, Aug. 27, 2000, SDS Corp., Ltd.

Fluid Hammer—Benefits of steering the Fluid Hammer, www.sdscorp.com au/strng.html, Aug. 27, 2000, SDS Corp., Ltd.

Fluid Hammer—Statoil—Norway—Case Study, www.sdscorp.com.au/stny.html, Aug. 27, 2000, SDS Corp. Ltd.

Fluid Hammer—Talisman Poco Highhat—Case Study, www.sdscorp.com.au/talis.html, Aug. 27, 2000, SDS Corp. Ltd.

Fluid Hammer—Technical Operating Data, www.sdscorp.com.au/techda.html, Aug. 27, 2000, SDS Corp. Ltd.

Fluid Hammer—Technical Data, www.sdscorp.au/techda.html, Aug. 27, 2000, SDS Corp., Ltd.

Huy Bui, David Drake, Matt Hairford,John Meyers, Albert Yost, "Directional Air Hammer Can Eliminate Expensive Location Costs", CADE/CAODC Spring Drilling Conf.; Calgary, Alberta Can., Apr. 8, 1997, pp. 1-11, Issue Paper No. 97-137, CADE/CAODC, Calgary.

Products—Agitator, www.andergauge.com/pub/products/tator/index.html, Aug. 27, 2000, Andergauge Drilling Systems.

* cited by examiner

PERCUSSION TOOL AND METHOD

This application is a divisional application of my co-pending patent application bearing Ser. No. 10/371,373 filed 19 Feb. 2003 now U.S. Pat. No. 7,011,156.

BACKGROUND OF THE INVENTION

This invention relates to a device and a method for delivering an impact or a force to a device. More particularly, but not by way of limitation, this invention relates to a percussion apparatus used with tubular members.

Rotary bits are used to drill oil and gas well bores, as is very well understood by those of ordinary skill in the art. The monetary expenditures of drilling these wells, particularly in remote areas, can be a very significant investment. The daily rental rates for drilling rigs can range from a few thousands dollars to several hundreds of thousands of dollars. Therefore, operators have requested that the well bores be drilled quickly and efficiently.

Prior art drill bits include, for instance, the tri-cone rotary bit. The tri-cone bit has been used successfully for many years. The rock will be crashed by the impact of the tri-cone buttons. Also, the PDC bit (polycrystalline diamond compact bit) has been used with favorable success. The PDC cutters do not crash, but will shear off the rock. Both bit types have their advantages, nevertheless tri-cone bits, utilizing the crashing action, are more universally useable. Therefore, attempts have been made to enhance the impact and hence the crashing action utilizing separate impact and/or jarring tools in order to drill wells or as an aid in drilling wells. However, those attempts have been largely case limited, non-economical, or unsuccessful.

Therefore, there is a need for a device that can deliver an impact and a force to a drilling tool, like a bit. There is a further need for a percussion-impacting tool that can be placed within a work string that will aid in the drilling and remedial work of wells. Further an impacting tool is needed that will aid to move a work string. There is also a need for a percussion-impacting tool that can be placed inside a tubular, for cleaning out the tubular. There is an additional need for percussion-impacting tools that can support compacting actions for cementing casing and tubing in well bores and others. These, and many other needs, will be met by the following invention.

SUMMARY OF THE INVENTION

A tool for delivering an impact and a force is disclosed. The tool comprises a cylindrical member having an internal bore, with the internal bore containing an anvil shoulder and a first guide profile. The tool further includes a first rotor disposed within the internal bore, and wherein the first rotor comprises a body having an outer circumference with a second guide profile thereon and an internal portion, and wherein the first rotor contains a radial hammer face. In a first position, the second external guide profile of the first rotor will engage with the first helical guide profile of the cylindrical member so that the radial hammer face can contact the anvil shoulder. In a second position, the second guide profile of the first rotor will engage with the first guide profile of the cylindrical member so that the radial hammer face is separated from the anvil shoulder.

In one embodiment, the internal bore of the cylindrical member contains a third guide profile and a second anvil shoulder. The tool further comprises a second rotor disposed within the internal bore, and wherein the second rotor comprises a body having an outer circumference with a fourth guide profile thereon, and wherein the second rotor member contains a second radial hammer face.

The fourth guide profile of the second rotor will engage with the third thread profile of the internal bore so that the second radial hammer face contacts the second anvil shoulder. The fourth guide profile of the second rotor will engage with the third guide profile of the internal bore so that the second radial hammer face is separated from the second anvil shoulder.

In the preferred embodiment, the first rotor further comprises a plurality of blades. The blades are arranged so that a flow stream therethrough will cause a rotation of the rotor. The flow stream may be either in a liquid, or gaseous state, or a combination of both.

The tool may further comprise a stator positioned within the internal bore, with the stator positioned to direct the flow stream to the first rotor. In the preferred embodiment, the stator comprises a cylindrical member having a plurality of blades disposed about a central core, and wherein the plurality of blades of the stator directs the flow stream to the first rotor so that the first rotor rotates.

A method of delivering an impact and a force to a tool is also disclosed. The method includes providing a device for delivering an impact or force to the tool, the device comprising a member having an internal bore with a first guide profile; a rotor disposed within the internal bore, and wherein the rotor comprises a body having an outer circumference with a second guide profile thereon, and wherein the rotor contains a radial hammer face. The method further includes flowing a flow stream down the internal bore and then flowing the flow stream through the internal portion of the rotor. The flow stream may be in a liquidized or gaseous state, or a combination of both. The rotor is rotated by the flow stream flowing therethrough.

Next, the first guide profile is engaged with the second guide profile so that the rotor travels in a direction opposite the flow of the flow stream. The rotor continues to rotate via the flow stream flowing therethrough. The first guide profile and the second guide profile engage so that the rotor travels in the same direction as the flow of the flow stream. When traveling in the same direction as the flow stream, the radial hammer face impacts against an anvil of the member having the internal bore. The radial hammer face of the rotor can also hit an anvil that is connected to any kind of tool like a bit when traveling in the same direction as the flow stream. Put another way, the rotor travels in an oscillating mode along the central axis of the member having the internal bore caused by the engagement between the first guide profile with the second guide profile.

The method further comprises continuing to flow the flow stream down the internal bore and through the rotor which in turn rotates the rotor by flowing the flow stream therethrough. The first guide profile and the second guide profile are engaged so that the rotor travels in a direction opposite the flow of the flow stream. As the flow stream continues to be flown, the rotor continues to rotate which in turn continues to engage the first guide profile with the second guide profile so that the rotor travels in the same direction as the flow of the flow stream, and the radial hammer face will, in turn, impact against the anvil.

In one of the preferred embodiments, the tubular member is connected to a drill bit member and the method further comprises drilling the well bore by percussion impacting of the radial hammer face against the anvil. In another of the preferred embodiments, the percussion sub is axially connected to a drill bit member. Alternatively, for example, the tubular member may be connected to an object stuck in a well, and the method further comprises jarring the object by percussion impacting of the radial hammer face against the anvil.

In yet another embodiment, a tool for delivering an alternating force is disclosed. The tool in this embodiment comprises a first member having an opening and first profile, with the first member having a first area thereon. A second member is disposed within the opening of the first member, with the second member containing a second profile, and a second area. The second member has a first position relative to the first member wherein the first profile cooperates with the second profile so that the second area contacts the first area. The second member has a second position relative to the first member wherein the first profile cooperates with the second profile so that the second area is separated from the first area. In one embodiment, the second member is a rotor, and wherein the rotor contains a plurality of blades disposed about a center core and wherein the plurality of blades turn in response to a flow stream flowing there through. Also, the first area may be an anvil shoulder, and the second area may be a hammer. In a preferred embodiment, the first member is a cylindrical member.

In yet another preferred embodiment, a tool for vibrating a cement slurry within a well bore is disclosed. The well bore will have a concentric casing string therein. The tool includes a first member attached to a cementing shoe, the cementing shoe being disposed at an end of the casing string. The first member has an anvil and a first profile thereon. The tool further contains a rotor disposed within the first member, with the rotor having a second profile and a hammer, and wherein the rotor is disposed to receive the cement slurry pumped down an inner portion of the casing string. The first profile will cooperate with the second profile, in a first position, so that the hammer contacts the anvil. The first profile further cooperates with the second profile, in a second position, so that the hammer is separated from the anvil. This oscillating movement of the rotor vibrates the cement slurry. In one embodiment, the rotor contains a plurality of blades disposed about a center core and wherein the blades turn in responsive to the cement slurry flowing there through. A stator may be included in order to direct the cement slurry into the blades of the rotor. In the preferred embodiment, the first member is a cylindrical member attached to the casing string within the well bore. A shock module member may be included, with the shock module member being operatively associated with the rotor.

The described percussion tool can be described more particularly, but not by way of limitation, as a percussion sub. An advantage of the presented percussion subs in drill strings will result in increase rates of drilling penetration. Another advantage is that the percussion sub may be used to free work strings that become stuck in a well. Still yet another advantage is that the percussion sub of the present invention can obtain very high vibration frequencies. For instance, frequencies of 20 Hz are possible.

Another advantage is that numerous configurations of the percussion sub are possible within a work string. For example, the percussion sub can be used in a drill string as an addition to existing drilling equipment; or the percussion sub used as a stand alone tool; or the percussion sub can be placed in more than one position in the drill string; or the percussion sub can be combined in series with more than one percussion subs. The percussion sub can also be an integral member of any other apparatus connected to a work string in order to function as a percussion tool.

Another advantage is that the percussion sub can also be used in a drill string with a rotary steerable assembly. Yet another advantage is that the percussion sub can be placed in a drill string having a motor or a turbine assembly. Still another advantage is that the percussion tool can be used to cement casing within a well bore.

A feature of the present invention includes use of a turbine type of design that utilizes a plurality of rotator blades. The flow stream flows through the internal portion of the rotor, through the blades so that the rotor rotates. Another feature is the rotor will have disposed thereon a guide profile that cooperates with a reciprocal guide profile that allows for a raised and lowered position. In one embodiment, the guide profile is on the outer circumference of the rotor, while in another embodiment, the guide profile is contained on an internal portion.

Another feature is that the flow through the internal bore of the percussion sub activates the percussion sub. The flow stream can be a liquid, a gas, a liquid stream with solids, a gas stream with solids, or a mixture of liquids, gas and solids. Still yet another feature is that the operator can control the frequency of the hammer striking the anvil by varying the pumping rate, by varying the guide profiles, by varying the number of rotors, or by varying the rotor arrangement. Yet another feature is that the operator can control the amount of impact of the hammer striking the anvil by varying the mud weight, by varying the guide profiles, by varying the blade design, or by varying the rotor weight. Still yet another feature is that the percussion sub will continue vibrating despite flow streams containing high solids contents.

Yet another feature is that the only moving part is the rotor with blades therein. Another feature is the novel guide profiles. The cooperating guide profiles are highly dependable and results in a minimum of moving components. Still another feature is the percussion tool can be placed in a casing string with a cementing shoe and the percussion tool is used to cement the casing string within the well bore.

DETAILED DESCRIPTION OF THE PREFERRED EMBODIMENTS

Figure 1A:
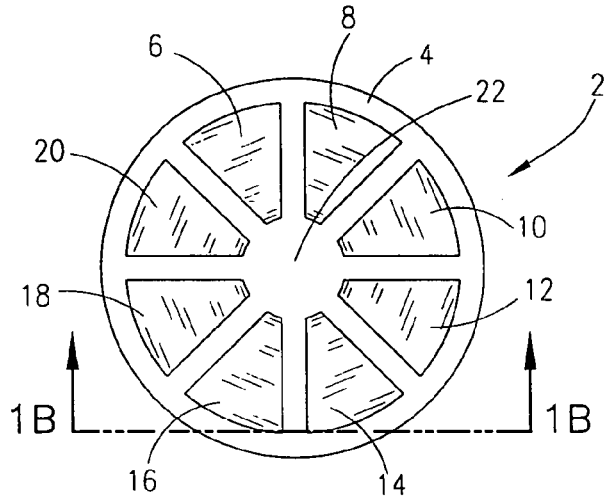
FIG. 1A is a top view of the rotor of the present invention.

Referring to FIG. 1A, a top view of the rotor 2 of the present invention will now be described. The rotor 2 comprises a generally cylindrical member having an outer wall 4 that extends radially inward to the internal portion 5; the rotor 2 contains a plurality of blades within the internal portion 5 (seen in FIG. 1B). Returning to FIG. 1A, the blades 6, 8, 10, 12, 14, 16, 18, 20 emanate from a center core 22. The blades 6-20 are disposed with a certain angle or pitch, as will be fully set out later in the application.

Figure 1B:
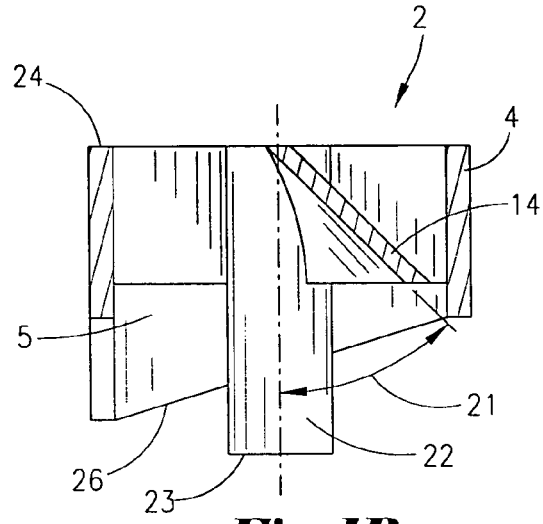
FIG. 1B is a cross-sectional view of the rotor from FIG. 1A taken along line I-I.

In FIG. 1B, a cross-sectional view of the rotor 2 from FIG. 1A taken along line I-I will now be described. It should be noted that like numbers appearing in the various figures refer to like components. As illustrated in FIG. 1B, the internal portion 5 has the center core 22, with the center core 22 having extending therefrom the blade 14 extending to the outer wall 4. The blade 14 is attached at one end to the center core 22 and at the other end to the outer wall 4. The center core 22 extends to the hammer radial face 23. The rotor 2 has a first radial surface 24 that is essentially flat and a second radial surface 26. The blade 14 has an angle of inclination of 45 degrees in the embodiment shown. It should be noted that the number of blades and the actual angle of inclination may vary. In other words, it may be that a greater number of blades in some applications are required, while in some instances, a lesser number of blades is required. Additionally, while an angle of inclination of 45 degrees is shown (denoted by the numeral 21), it should be understood that the angle may vary from zero (0) degrees to ninety (90) degrees. The rotor 2 is of similar construction to rotors of a turbine design that is commercially available from Smith International Inc. and Neyrfor Inc. under the trademark of Turbo Drill.

Figure 1C:
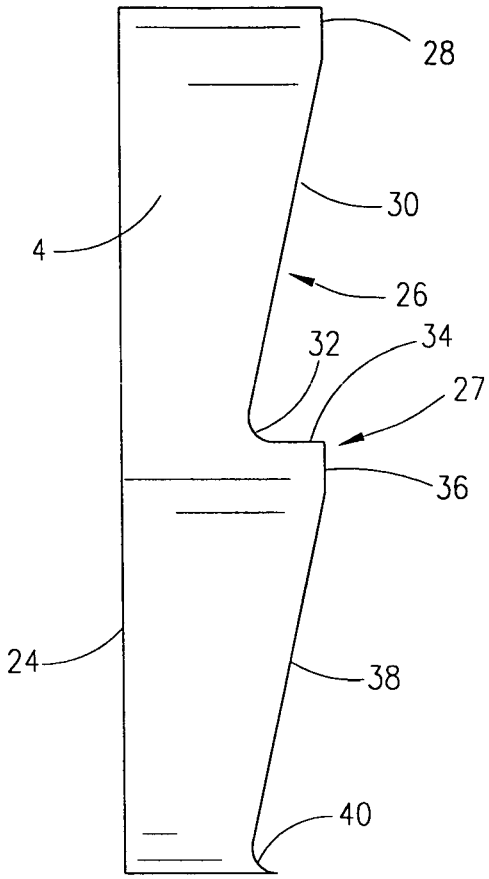
FIG. 1C is a circumference view of the rotor seen in FIG. 1A.

Referring now to FIG. 1C, a circumference view of the rotor 2 seen in FIG. 1A will now be described. In particular, FIG. 1C depicts the circumference view of the outer wall 4. The outer wall 4 has the first flat radial surface 24 and the second surface 26. FIG. 1C depicts that the second radial surface 26 is a jagged saw tooth profile 27, which begins at the surface 28 which then slopes generally downward, as denoted by the numeral 30 which in turn concludes at curved surface 32, with the curved surface 32 having a radius of 0.125 inches in the preferred embodiment. The curved surface 32 extends to the vertically extending surface 34 which in turn extends to the second surface 36. The second surface 36 will again extend to the generally downward sloped surface 38 and wherein the sloped surface 38 concludes at the curved surface 40, with the curved surface 40 having a radius of 0.125 inches in the preferred embodiment.

Figure 2A:
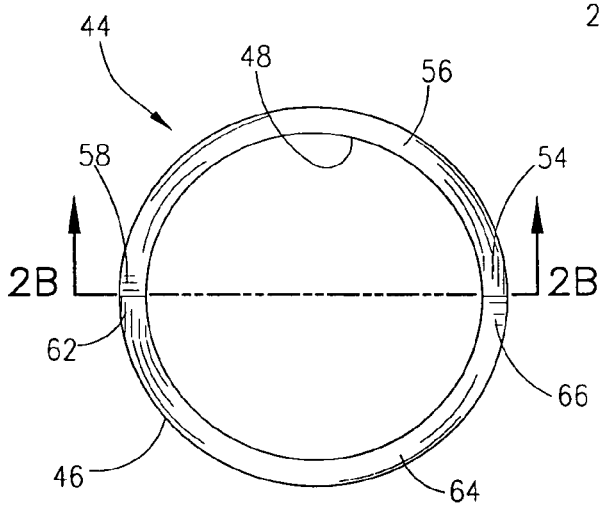
FIG. 2A is a top view of the sleeve of the present invention.
Figure 2B:
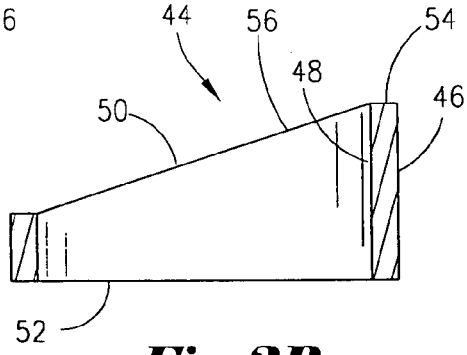
FIG. 2B is a cross-sectional view of the sleeve from FIG. 2A taken along line II-II.
Figure 2C:
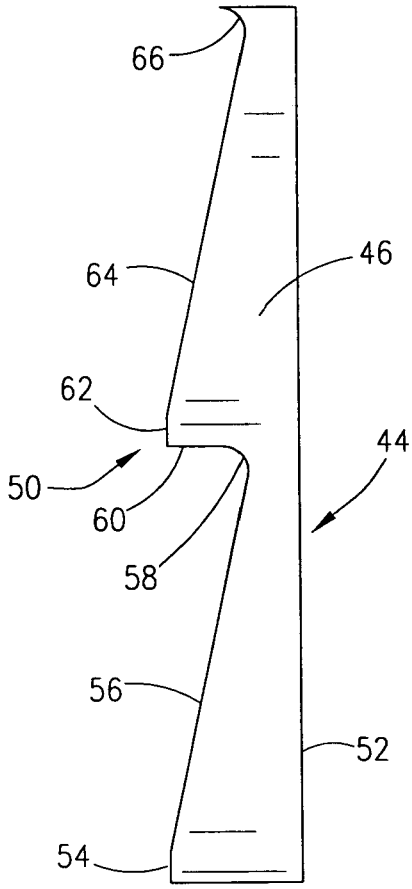
FIG. 2C is a circumference view of the sleeve seen in FIG. 2A.

Reference is now made to FIG. 2A which is a top view of the sleeve 44 of the present invention. The sleeve 44 is a generally cylindrical member that contains an outer wall 46 and an inner surface 48. FIG. 2B is a cross-sectional view of the sleeve 44 from FIG. 2A taken along line I-I. The sleeve 44 has a top surface profile, seen generally at 50, and a bottom surface, seen generally at 52. The top surface 50 is an essentially matching jagged saw-tooth profile 50 with the second surface 26 of the rotor 2. Referring now to FIG. 2C, the circumference view of the sleeve 44, and in particular the outer wall 46, seen in FIGS. 2A and 2B will now be described. The second surface 50 is a jagged saw-tooth profile 50 which begins at the surface 54 which then slopes generally downward, as denoted by the numeral 56 which in turn concludes at curved surface 58, with the curved surface 58 having a radius of 0.125 inches in the preferred embodiment. The curved surface 58 extends to the vertically extending surface 60 which in turn extends to the second surface 62. The second surface 62 will again extend to the generally downward sloped surface 64 and wherein the sloped surface 64 concludes at the curved surface 66, with the curved surface 66 having a radius of 0.125 inches in the preferred embodiment.

Figure 3A:
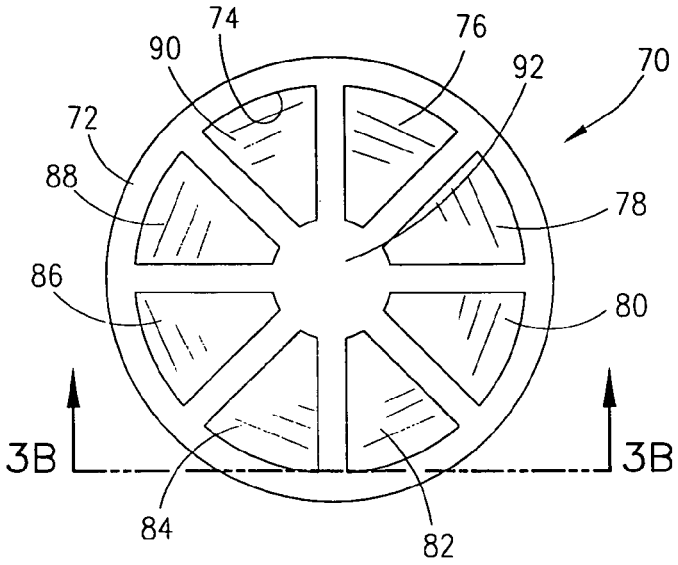
FIG. 3A is a top view of the stator of the present invention.

A stator 70 is seen in a top view in FIG. 3A. The stator 70 is generally cylindrical and contains an outer wall 72 that in turn extends to an inner diameter surface 74. The stator 70 has disposed therein a plurality of blades, namely blades 76, 78, 80, 82, 84, 86, 88, 90. The stator blades will be attached at one end to the inner diameter surface 74 and at the other end to the center core 92. The stator blades will be disposed at an angle of inclination that will be more fully explained with reference to FIG. 3B.

Figure 3B:
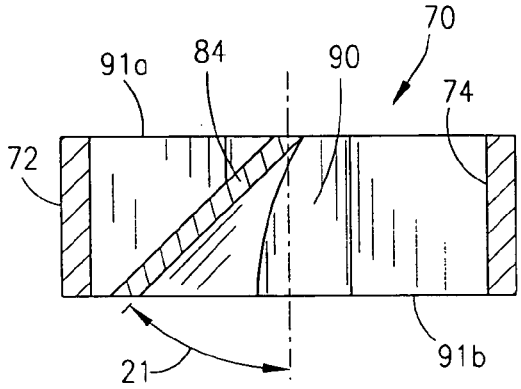
FIG. 3B is a cross-sectional view of the stator from FIG. 3A taken along line III-III.

Referring now to FIG. 3B is a cross-sectional view of the stator 70 from FIG. 3A taken along line A-A. Stator 70 has a first end 91*a* and second end 91*b*. The blade 84 as an example is shown sloping downward at an angle of inclination of 45 degrees. The other blades (76, 78, 80, 82, 86, 88, 90) will slope downward in a similar fashion at an angle of inclination of 45 degrees. As noted earlier, the actual angle of inclination can be varied. The stator is designed to direct the flow stream to the rotor as will be more fully explained later in the application. As noted earlier, the flow stream may be a liquid or a gas, or a mixture of both. The flow stream may also contain solids.

Figure 4B:
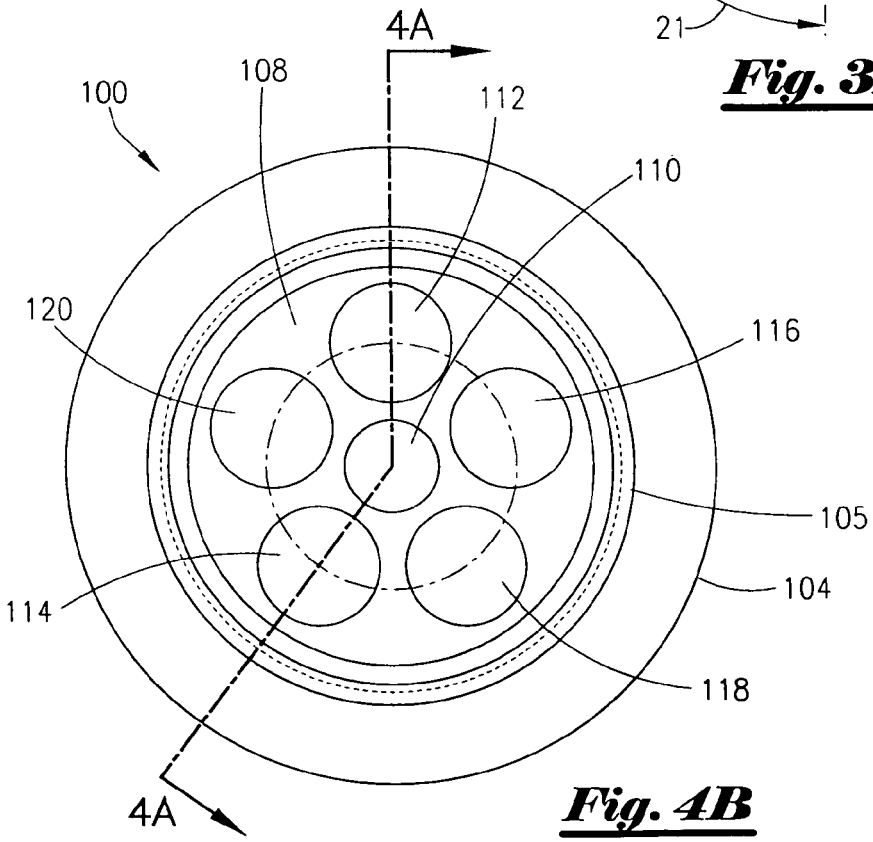
FIG. 4B is a top view of the percussion bottom sub.
Figure 4A:
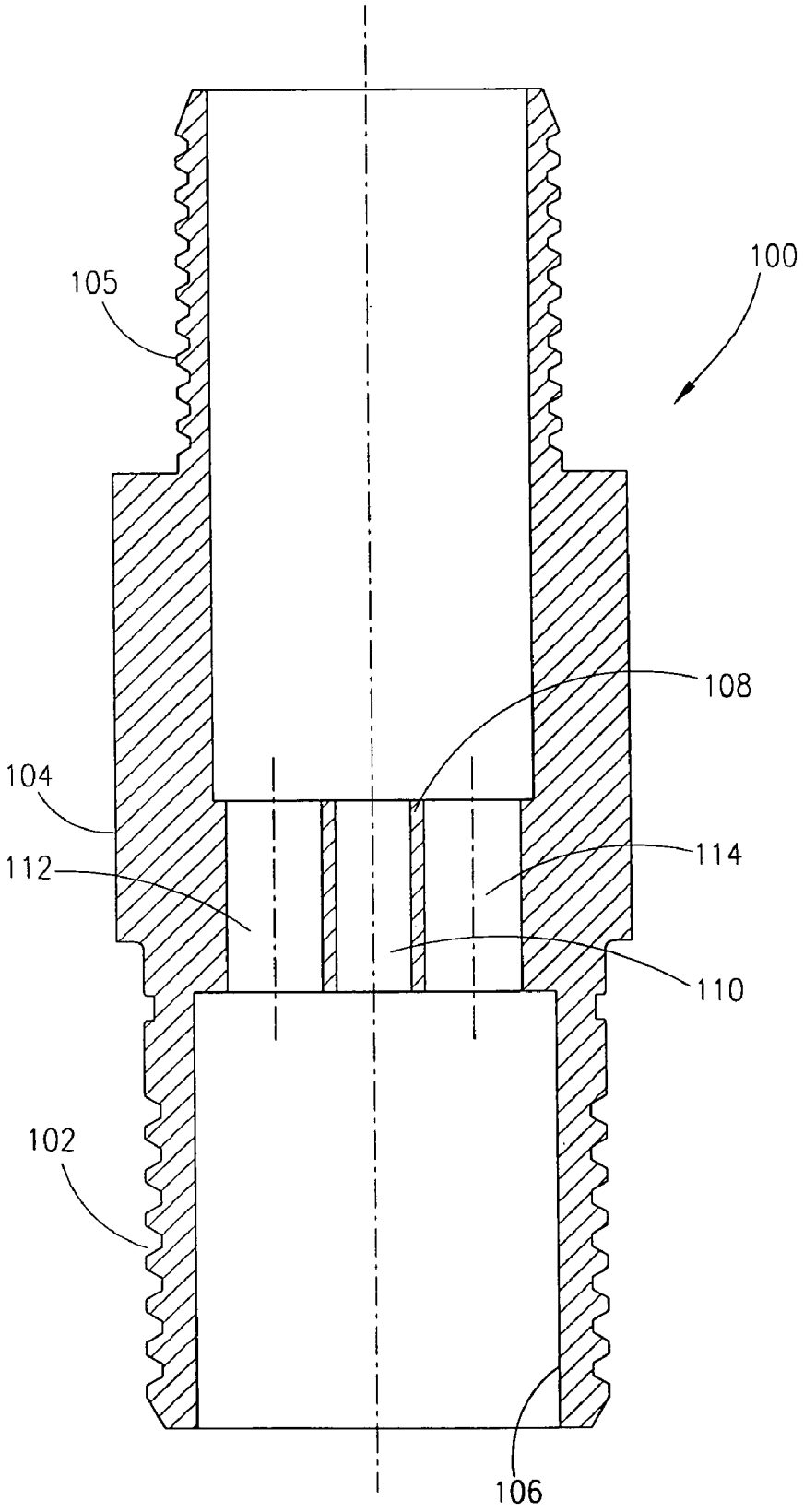
FIG. 4A is a cross-sectional view of the percussion bottom sub of the present invention.

Referring now to FIG. 4A, a cross-sectional view of the percussion bottom sub 100 of the present invention will now be described. The bottom sub 100 comprises a generally cylindrical body having a first thread surface 102 that extends to a second outer surface 104 which in turn extends to the second thread surface 105. Extending radially inward, the bottom sub 100 contains a first inner surface 106 that leads to center passage means 108. The center passage means 108 contains a plurality of openings, including the opening 110, which will have placed therein a nut and bolt which will serve as an anvil for an embodiment, as will be more fully explained later in the application. The center passage means 108 also contains openings spaced about the opening 110, with these openings being generally aligned with the rotor 2 thereby providing an output path for the flow stream; in FIG. 4A, openings 112 and 114 are shown disposed through the center passage means 108.

In FIG. 4B, a top view of the percussion bottom sub 100 will now be described. The opening 112 and the opening 114 is shown, along with the other openings 116, 118, 120. The center 110 will have placed therein a nut and bolt for the anvil, which is not shown in this view.

Figure 5:
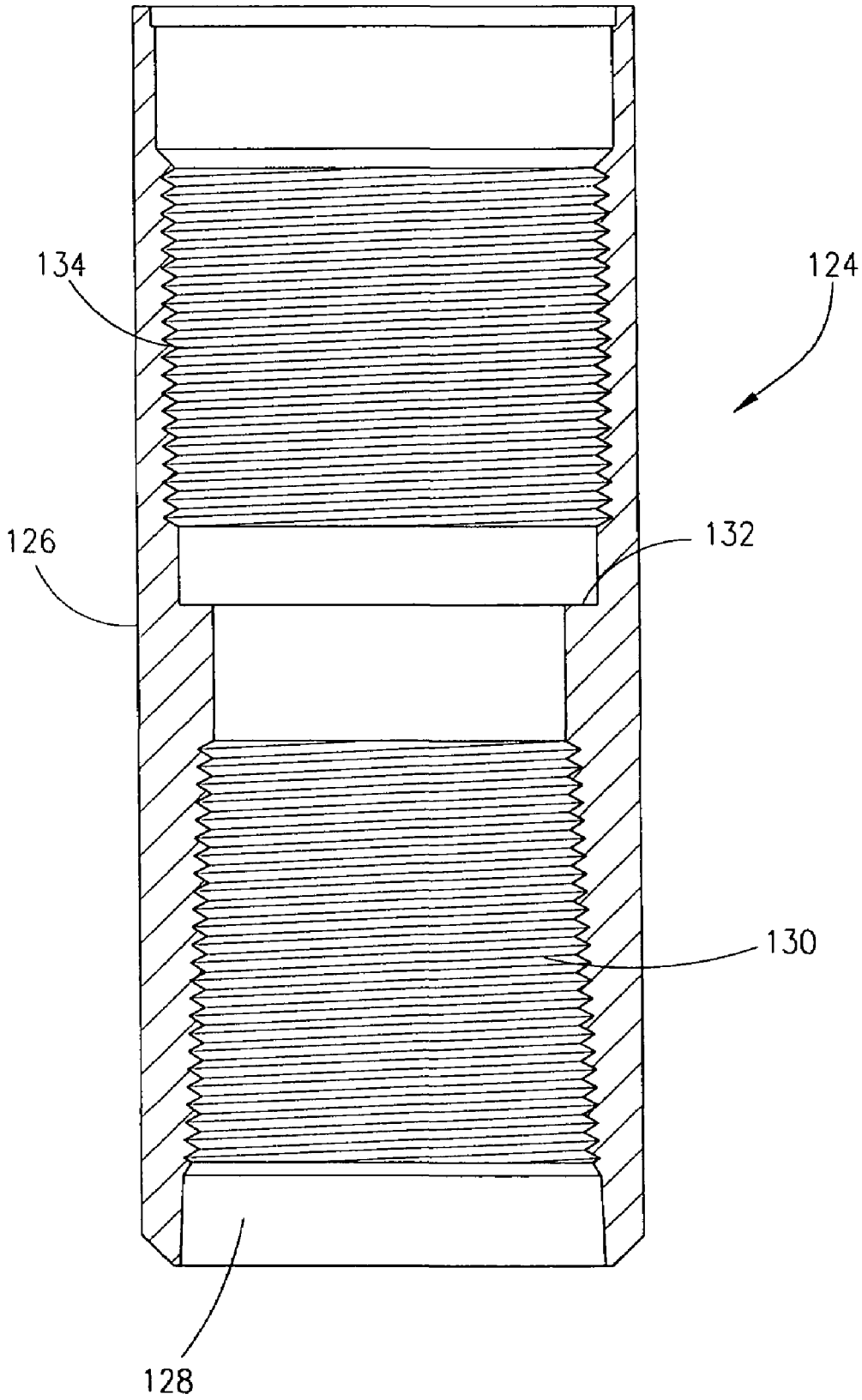
FIG. 5 is a cross-sectional view of the percussion top sub of the present invention.

Referring now to FIG. 5, a cross-sectional view of the percussion top sub 124 of the present invention will now be described. The percussion top sub 124 is a generally cylindrical member that includes an outer surface 126 which extends to an internal bore 128. The internal bore 128 contains an internal thread 130 that in turn extends to a shoulder 132. The shoulder 132 extends to the internal thread means 134. The percussion top sub 124 and percussion bottom sub 100 are threadedly connected.

Figure 6A:
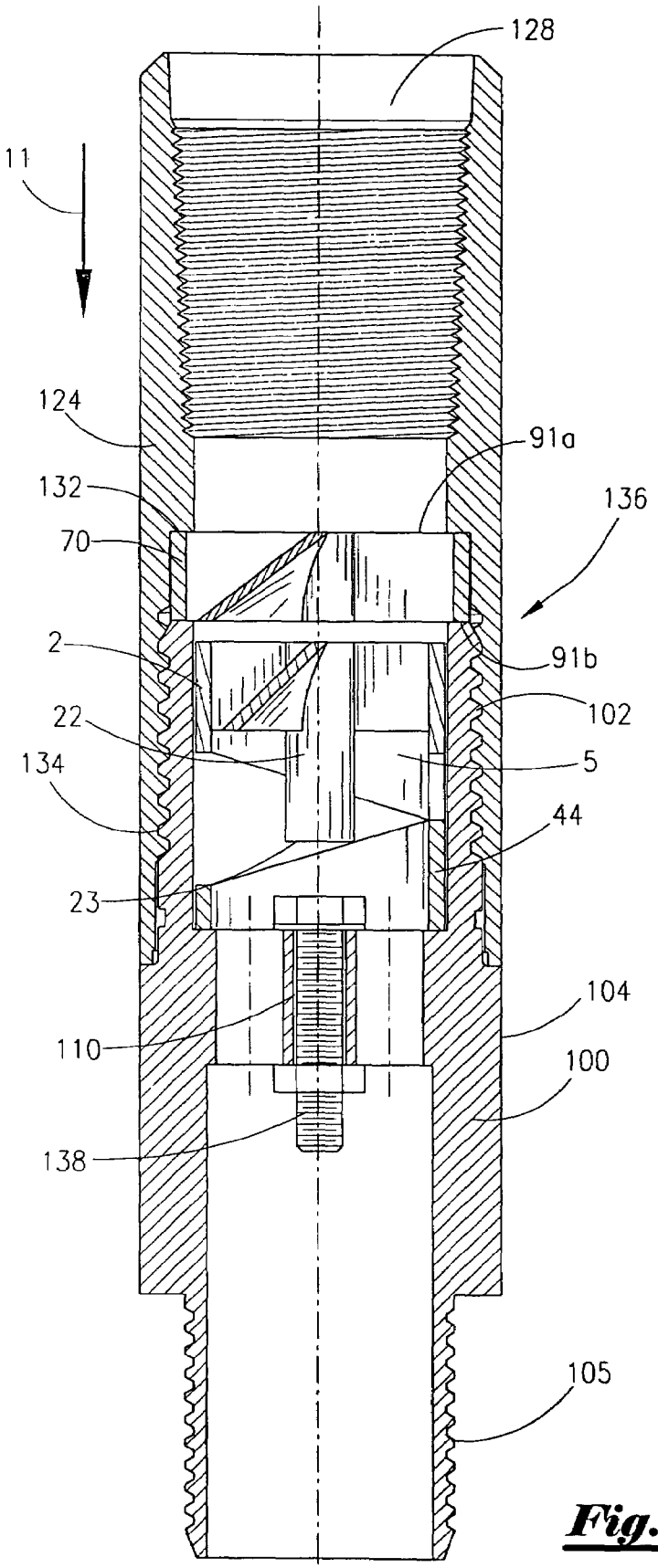
FIG. 6A is a partial cross-sectional view of the preferred assembled percussion sub shown in the raised position.

FIG. 6A is the preferred embodiment of the assembled percussion sub 136 seen in a partial cross-section in the raised position. The internal thread means 134 will threadedly engage with the thread surface 102 thereby connecting the percussion top sub 124 and the percussion bottom sub 100. Thus, the stator 70 has its first end 91*a* abutting the shoulder 132. It should be noted that in some of the embodiments herein disclosed, the stator 70 itself is an optional component, as will be more fully explained later in the application. The stator 70 in turn is adjacent the rotor 2. The stator 70 will direct the flow stream into the rotor 2. The rotor 2 is positioned so that the jagged saw-tooth guide profile 27 (as seen in FIG. 1B) will be adjacent the sleeve 44, and in particular, the jagged saw-tooth guide profile 50 (as seen in FIG. 2C) wherein the cooperation of the profiles will result in the percussion effect of the present invention. The bolt 138 is seen disposed within the opening 110. The bolt 138 will serve as the anvil. Since the rotor 2 will be rotating during a flow down the bore 128 of the sub 136 and the internal portion 5 of the rotor 2, the jagged saw-tooth guide profile 27 (as seen in FIG. 1B) of the rotor with the complementary jagged saw-tooth profile 50 (as seen in FIG. 2C) of the sleeve will cause the rotor to raise then lower and strike with the hammer radial face the bolt 138, serving as anvil, which in turn transmits the impact to the percussion sub 136. The direction of flow of the fluid stream is denoted by the arrow 11 in FIG. 6A.

The frequency of the impact can be affected by several factors including the rate of pumping through the percussion sub 136. Other factors include the specific design of the profile, like the number of jagged saw-teeth. It should be understood that the percussion sub may be mounted in conjunction with a bit, or in work strings that contain other types of bottom hole assemblies. For instance, the percussion sub could be included on a fishing work string to aid in providing a jarring action when so desired by the operator. In the case wherein the percussion sub 136 is connected to a bit, the bit will be subjected to the impact.

The sleeve 44 is fixedly connected to the percussion bottom sub 100 by conventional means such as welding or thread means or can be formed integrally thereon.

Figure 6B:
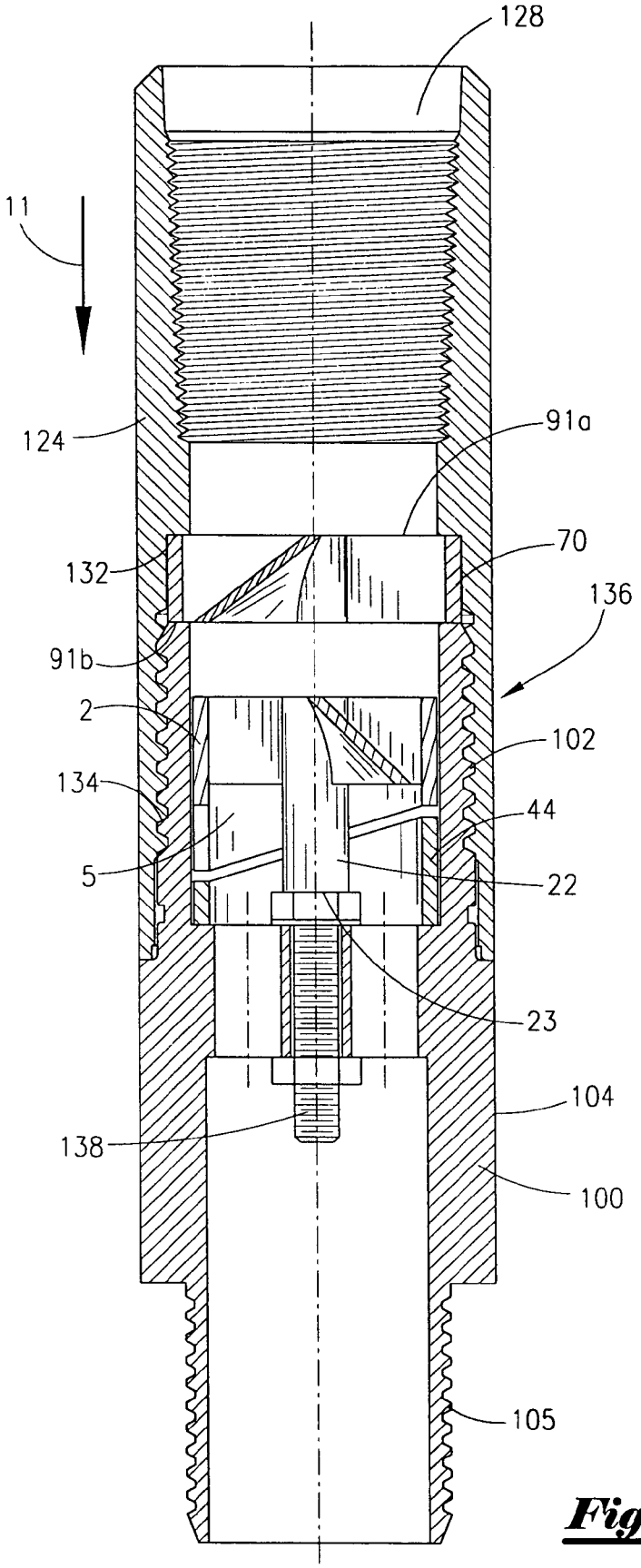
FIG. 6B is a partial cross-sectional view of the preferred assembled percussion sub of FIG. 6A shown in the lowered position.

FIG. 6A depicts the assembly while the rotor 2 has been raised due to the interaction of the jagged profile of the rotor 2 against the jagged guide profile of the sleeve 44. The rotor 2 moves reverse to the direction of the flow of the flow stream when moving in the rotary motion. FIG. 6B depicts the assembly in FIG. 6A while the rotor 2 has been lowered in order to strike the sleeve, with the lowering being due to the interaction of the jagged guide profile of the rotor 2 against the jagged profile of the sleeve 44. In particular, the hammer radial face 23 of the rotor 2 contacts the bolt 138. As seen in FIG. 6B, the rotor 2 moves in the same direction of the flow of the flow stream when moving in a linear motion.

Figure 7B:
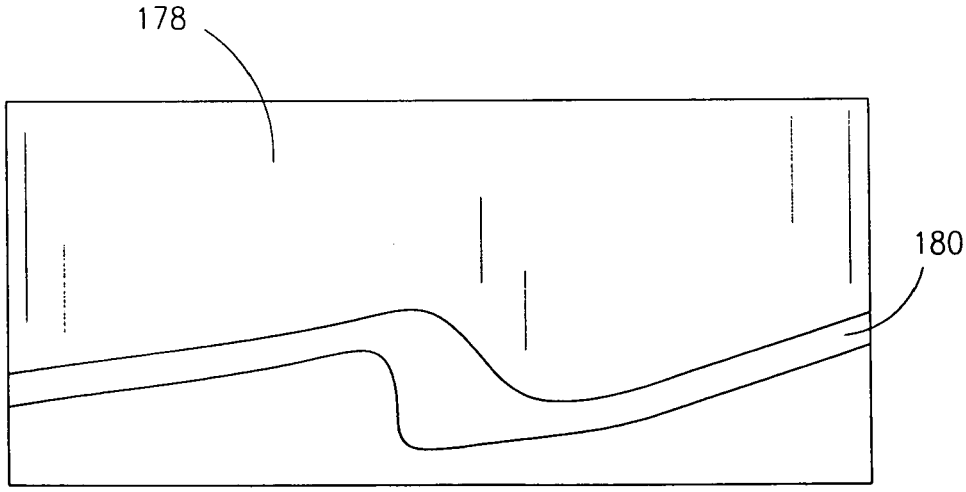
FIG. 7B is a schematic illustration of a laid out helical profile.
Figure 7A:
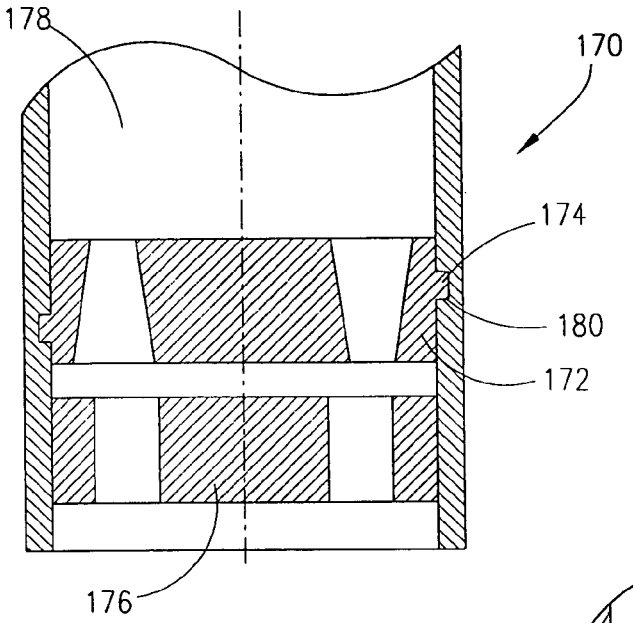
FIG. 7A is a schematic illustration of a percussion sub embodiment having a rotor with external guide and an anvil.

Referring now to FIG. 7A, a schematic illustration of a percussion sub 170 embodiment having a rotor 172 with external guide profile 174 and an anvil 176 will now be described. In this embodiment, the rotor 172 will be rotated by the flow of a flow stream down the inner bore 178. The sub 170 will be situated within a work string, as previously discussed. Thus, as the rotor 172 is rotated, the external guide profile 174 will cooperate with an inner guide profile 180 located on the inner body of the sub 170. In accordance with the teachings of the present invention, as the rotor 172 turns, the cooperation of the external profile 174 and the internal profile 176 will cause a raising of the rotor 172 and in turn a lowering of rotor 172 which results in a striking of the hammer (rotor 172) against the anvil 176. It should be noted that the external guide profile and internal guide profiles herein described will be similar to the jagged saw-tooth guide profile previously discussed in that the profiles provide a guide for cooperative engagement of the rotor to rotate as well as to raise and lower. The profiles for FIGS. 7A through 13 have a helical type of profile. The helical profile may take the form of a thread profile due to the curved nature of the profile about a cylindrical surface. FIG. 7B depicts a laid out the helical profile.

Figure 8:
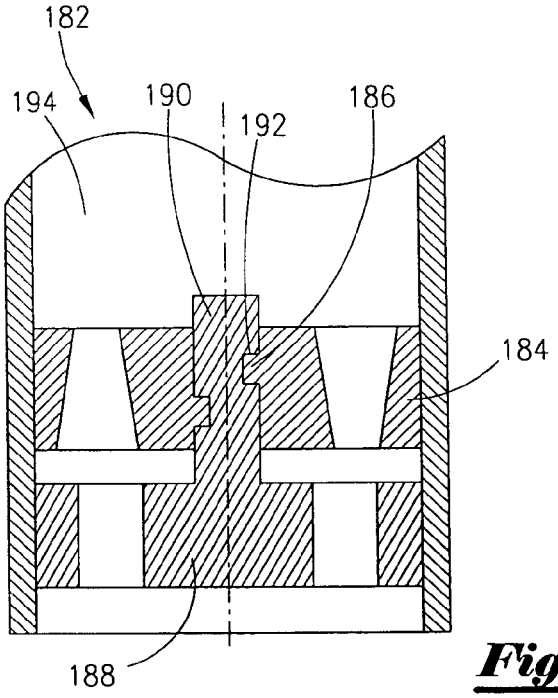
FIG. 8 is a schematic illustration of another percussion sub embodiment having a rotor with internal guide and an anvil.

In FIG. 8, a schematic illustration of another percussion sub 182 embodiment having a rotor 184 with internal guide profile 186 and an anvil 188 will now be described. The anvil 188 is either formed on the sub 182 or affixed to the sub by conventional means such as threads, welding, press fitting and other means. The anvil has a center section 190 that extends therefrom, with the center section 190 containing a guide profile 192. In this embodiment, the rotor 184 will be rotated by the flow of the flow stream down the inner bore 194. The sub 182 will be situated within a work string, as previously discussed. Thus, as the rotor 184 is rotated, the internal guide profile 186 will cooperate with the guide profile 192 located on the center section 190 of the anvil 188. In accordance with the teachings of the present invention, as the rotor 184 turns, the cooperation of the guide profile 192 and the guide profile 186 will cause a raising of the rotor 184 and in turn a lowering of rotor 184 which results in a striking of the hammer (i.e. rotor 184) against the anvil 188.

Figure 9:
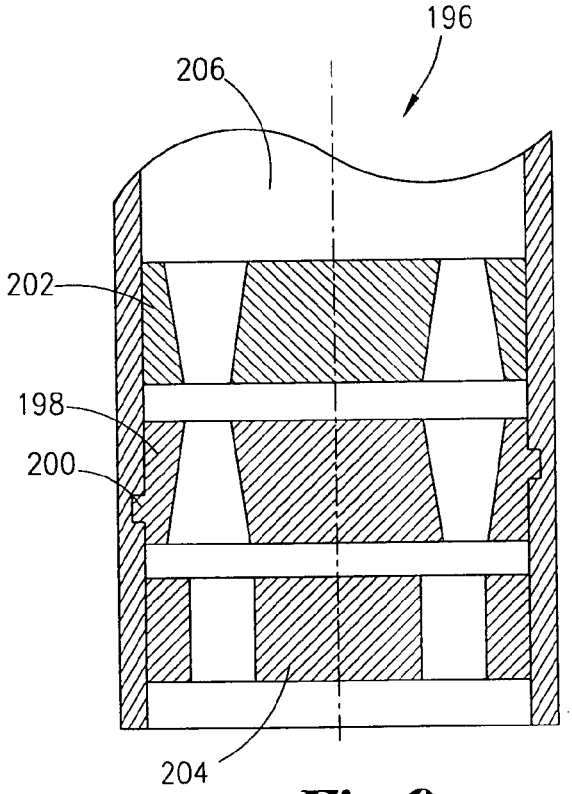
FIG. 9 is a schematic illustration of another percussion sub embodiment having a rotor with external guide, a stator and an anvil.

In FIG. 9, a schematic illustration of another percussion sub 196 embodiment having a rotor 198 with external guide 200, a stator 202 and an anvil 204 is shown. In the embodiment of FIG. 9, the stator 202 will direct the flow of the flow stream through the inner bore 206. The flow will cause the rotor 198 to rotate wherein the external guide 200, which is formed on the rotor 198, will cooperate with the external guide 200, which is formed on the wall of the percussion sub 196. Hence, the rotor 198 will raise then lower thereby causing the hammer effect as previously described.

Figure 10:
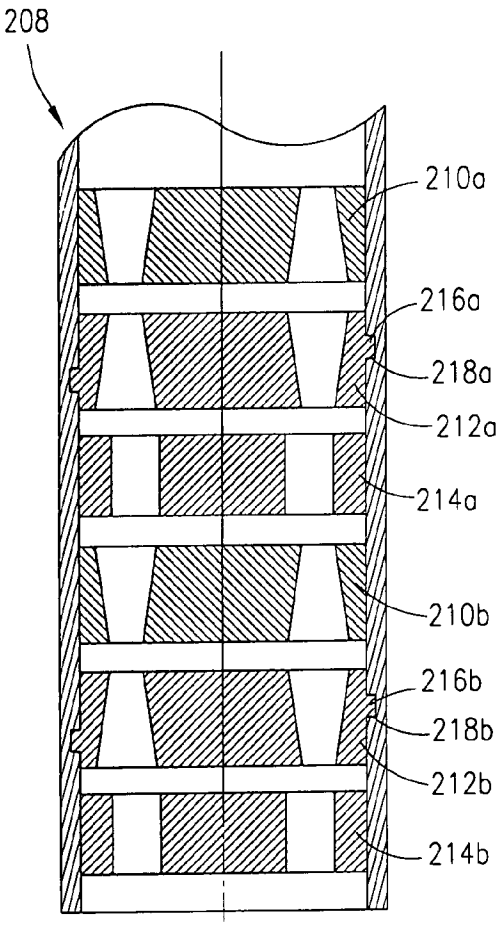
FIG. 10 is a schematic illustration of another percussion sub embodiment having multiple rotors with external guides, stators and anvils.

In FIG. 10, a schematic illustration of another percussion sub 208 embodiment having multiple rotors with external guides, stators and anvils will now be described. More particularly, the stator 210*a* directs flow of the flow stream to the rotor 212*a*. The anvil 214*a* is connected to the percussion sub 208. The rotor 212*a* has an external guide profile 216*a* that will cooperate with the internal guide profile 218*a* which in turn will raise the rotor 212*a*, then lower the rotor 212*a* thereby striking the anvil 214*a*.

Mounted in tandem is stator 210*b* which receives the flow and then directs flow to the rotor 212*b*. The anvil 214*b* is connected to the percussion sub 208. The rotor 212*b* has an external guide profile 216*b* that will cooperate with the internal guide profile 218*b* which in turn will raise the rotor 212*b*, then lower the rotor 212*b* thereby striking the anvil 214*b*.

Figure 11:
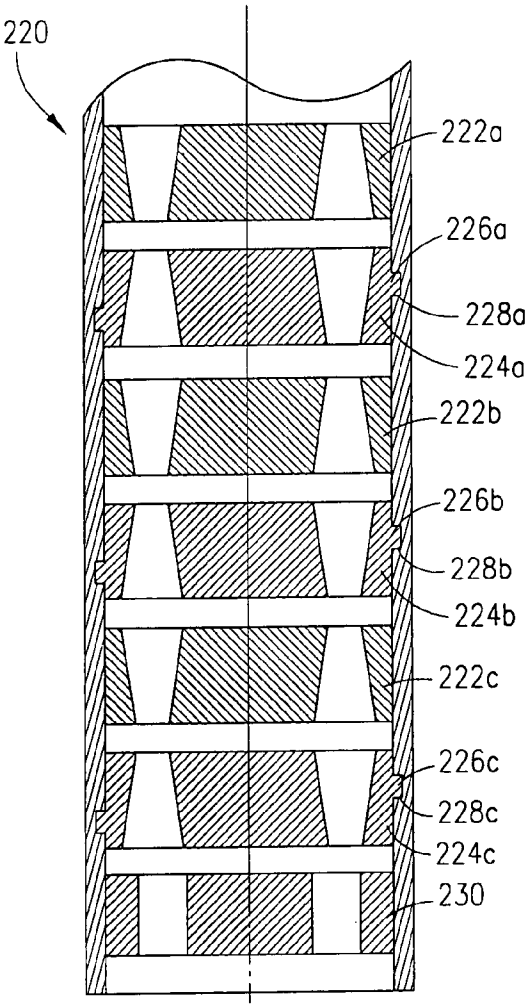
FIG. 11 is a schematic illustration of another percussion sub embodiment having multiple rotors, stators, and anvils, whereby some stator function as anvils.

FIG. 11 is a schematic illustration of another percussion sub 220 embodiment having multiple rotors and stators and wherein the stators function as anvils. As seen in FIG. 11, a stator 222*a* directs flow of the flow stream to the rotor 224*a* and wherein the rotor 224*a* has an external guide profile 226*a* that will cooperate with an internal guide profile 228*a* formed on the internal portion of the percussion sub 220. Thus, the rotor 224*a* will be rotated which in turn causes the raising and then lowering of the rotor 224*a* thereby striking the stator 222*b*. Note that the stator 222*b* acts as an anvil for the rotor 224*a*.

In the embodiment of FIG. 11, the second stator 222*b* directs flow to the second rotor 224*b* and wherein the rotor 224*b* has an external guide profile 226*b* that will cooperate with an internal guide profile 228*b* formed on the internal portion of the percussion sub 220. Thus, the rotor 224*b* will be rotated which in turn causes the raising and then lowering of the rotor 224*b* thereby striking the stator 222*c*, wherein the stator 222*c* serves as an anvil. Additionally, stator 222*c* directs flow to the rotor 224*c* and wherein the rotor 224*c* has an external guide profile 226*c* that will cooperate with an internal guide profile 228*c* formed on the internal portion of the percussion sub 220. Thus, the rotor 224*c* will be rotated which in turn causes the raising and then lowering of the rotor 224*c* thereby striking the anvil.

Figure 12:
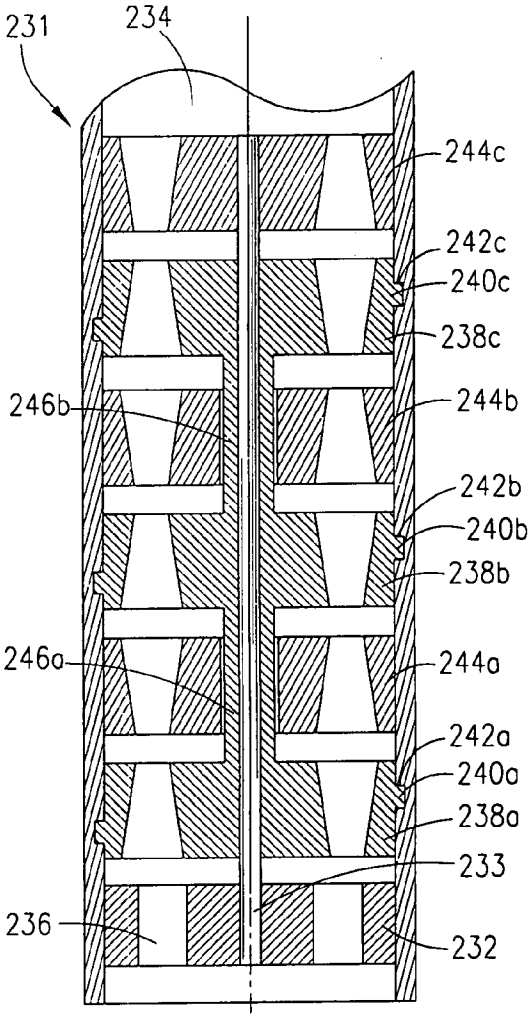
FIG. 12 is a schematic illustration of another percussion sub embodiment having multiple rotors with more than one external guide and multiple stators functioning as anvils, whereby all the rotors are interconnected.

Referring now to FIG. 12, a schematic illustration of another percussion sub 231 embodiment having multiple rotors and stators and anvils wherein the rotors are contacting each other, therefore, allowing for all rotors to oscillate in the same direction and frequency. The percussion sub 231 contains an anvil 232 that is connected to the sub 231 and has a center section 233 extending through the inner bore 234 of the sub 231. The anvil 232 has ports 236 for the passage of the flow through the inner bore 234 and through the rotors and stators. The percussion sub 231 includes a rotor 238*a* that is disposed about the center section 233. The rotor 238*a* has an external guide profile 240*a* that will engage within an internal guide profile 242*a* for cooperation as previously described. A stator 244*a* will direct flow of the flow stream to the rotor 238*a* which in turn will cause rotor 238*a* to rotate.

The rotor 238*a* is fixedly attached, such as by thread means, splines or couplings, via a shaft 246*a* to the rotor 238*b*. The shafts 246*a* consist of interconnecting pieces, with the interconnection being protruding teeth that cooperate with reciprocal grooves. The shafts 246*a* and 246*b* can also be interconnected via other means such as thread means.

The stator 244*b* directs the flow to the rotor 238*b*. The rotor 238*b* has an external guide profile 240*b* that cooperates with the internal guide profile 242*b*. In this embodiment, the raising and lowering of the rotor 238*b* will strike the stator 244*a*; hence, stator 244*a* acts as an anvil. The rotor 238*b* is fixedly attached, such as by thread means, via a shaft 246*b* to the rotor 238*c*. The stator 244*c* directs the flow to the rotor 238*c*. The rotor 238*c* has an external guide profile 240*c* that cooperates with the internal guide profile 242*c*. In this embodiment, the raising and lowering of the rotor 238*c* will strike the stator 244*b*. In operation, the rotors 238*a*, 238*b*, 238*c* will rotate in phase and rise and lower in phase, since they are connected.

Figure 13:
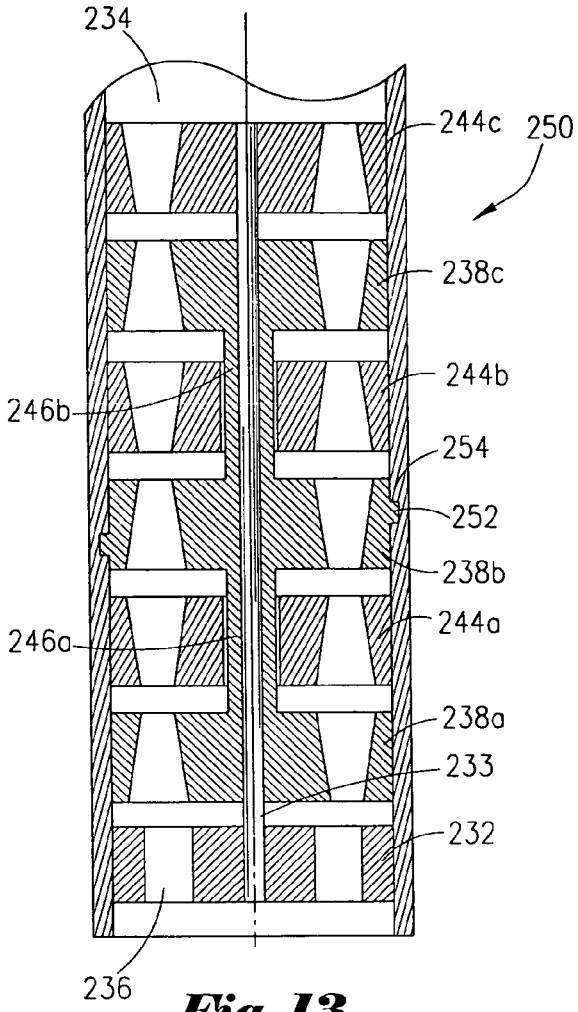
FIG. 13 is a schematic illustration of another percussion sub embodiment having multiple rotors with one external guide and multiple stators functioning as anvils, whereby all the rotors are connected to each other.

FIG. 13 is a schematic illustration of another percussion sub 250 embodiment having multiple rotors, and stators. The percussion sub 250 is similar to the percussion sub 231 of FIG. 12 except that there is only a single external guide profile 252 that cooperates with and engages into the internal guide profile 254. The other components found in FIG. 13 are similar to those found in FIG. 12, and similar numerals refer to like components. Thus, as flow of the flow stream is directed down the bore 234, external guide profiles 252 engagement with the internal guide profile 254 will cause all of the rotors to rise, then fall striking the corresponding stators.

Figure 14:
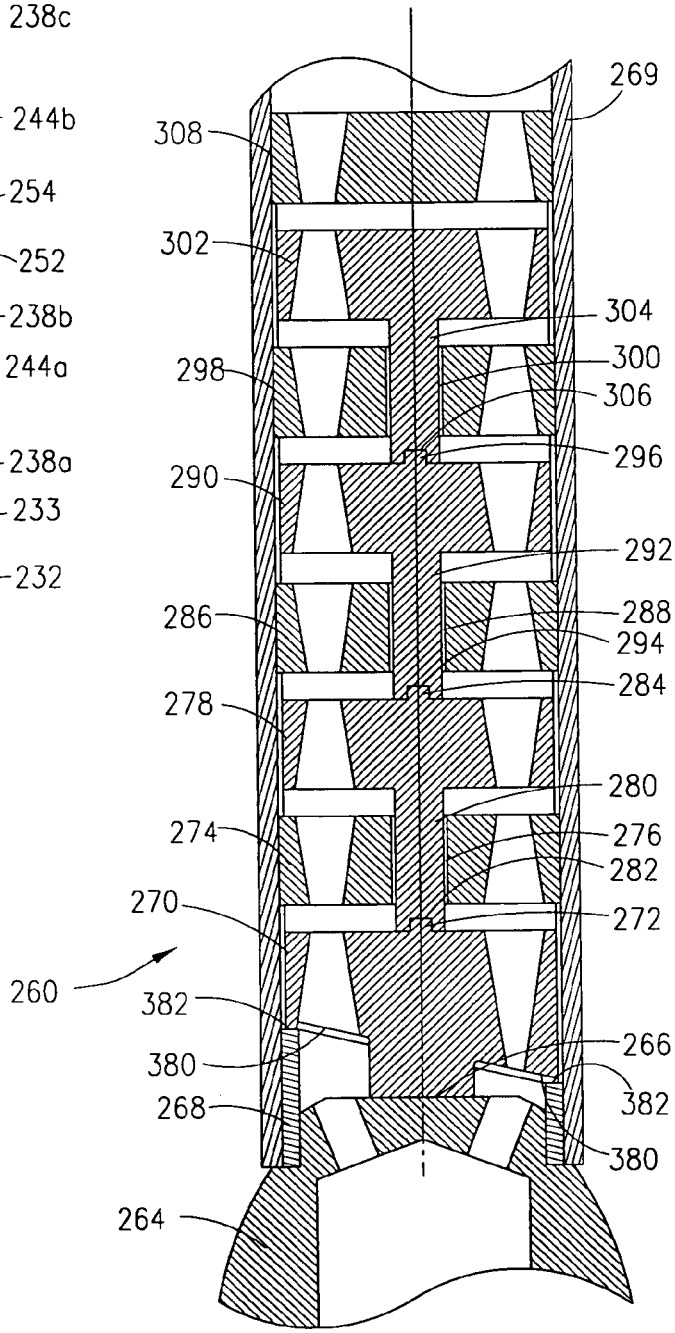
FIG. 14 is a schematic illustration of another percussion sub embodiment having multiple rotors, multiple stators, with an axial moveable bit attached thereto.

With reference to FIG. 14, a schematic illustration of another percussion sub 260 embodiment having multiple rotors, stators, with a bit attached thereto will now be described. The embodiment of FIG. 14 also illustrates an interconnection means for interconnecting the rotors. Additionally, in the embodiment of FIG. 14, the bit that is connected to the tubular string is axial moveable relative to the tubular string. More specifically, the bit 264 is axially attached by conventional spline means with the top of the bit serving as an anvil 266. The splines, schematically illustrated at 268, are provided for allowing axial movement of the bit 264 relative to the tubular member 269 of sub 260 in oscillating movement, thereby allowing the incremental axial extension of the bit into the formation face. Please note that the tubular member 269 will be connected to a work string such as a drill string. The spline means consist of a series of projections on a bit shaft that fit into slots on the corresponding tubular 269, enabling both to rotate together while allowing axial lateral movement, as is well understood by those of ordinary skill in the art.

At the top portion of the rotor 270 is the projection 272. A first stator 274 is provided so that the flow stream is directed to the rotor 270, as previously described. The stator 274 has a bore 276 disposed there through. The second rotor 278 is disposed within the sub 260, and wherein the rotor 278 contains a stem 280 disposed through bore 276. The stem 280 contains a groove 282, and wherein the groove 282 will cooperate with the projection 272. The groove 282 and projection 272 are the interconnection means for interconnecting the rotors for rotational movement and are similar to a tongue in groove arrangement.

At the top portion of the rotor 278 is the projection 284. A second stator 286 is provided so that the flow stream is directed to the rotor 278, as previously described. The stator 286 has a bore 288 disposed there through.

The third rotor 290 is disposed within the sub 260, and wherein the rotor 290 contains a stem 292 disposed through bore 288. The stem 292 contains a groove 294, and wherein the groove 294 will cooperate with the projection 284. The groove 294 and projection 284 are the interconnection means. At the top portion of the rotor 290 is the projection 296. A third stator 298 is provided so that the flow stream is directed to the rotor 290, as previously described. The stator 298 has a bore 300 disposed there through.

The fourth rotor 302 is disposed within the sub 260, and wherein the rotor 302 contains a stem 304 disposed through the bore 300. The stem 304 contains a groove 306, and wherein the groove 306 will cooperate with the projection 296. The groove 306 and projection 296 are the interconnection means. A fourth stator 308 is provided, and wherein the stator 308 directs the flow stream to the fourth rotor 302. Due to the interconnection of the rotors 270, 278, 290, 302, the rotors will rotate together as flow is directed therethrough. Thus, the rotors 270, 278, 290, 302 rise and fall (oscillate) in unison thereby providing the impact to the bit. In the embodiment shown in FIG. 14, the bit is actually impacted twice in a single cycle: first, by the rotors hitting the bit; second, by the falling work string, with the increment of downward movement of the work string being dependent upon the amount of hole created by the bit due to the first impact. The first rotor 270 has a guide profile 380 that is placed at the low side of the rotor 270. The tubular member 269 of the sub 260 has an opposing guide profile 382 located on the inner body of the sub 170. Hence, all interconnected rotors 270, 278, 290, 302 need only one pair of guide profiles (380, 382) to guide all rotors.

Figure 15A:
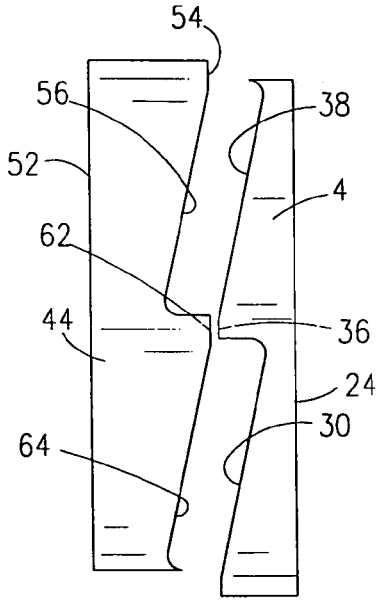
FIG. 15A depicts a schematic illustration of the circumference view of the rotor engaging the sleeve in a raised position.
Figure 15B:
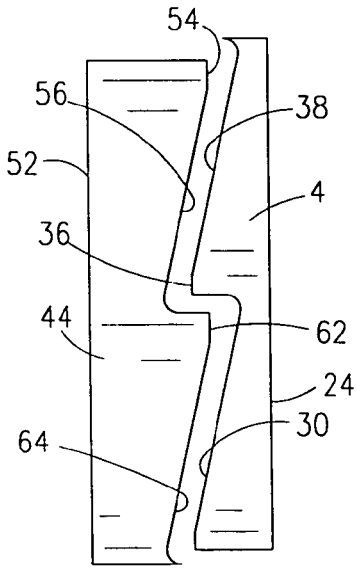
FIG. 15B depicts the rotor and sleeve of FIG. 14A in a lowered position.

Referring to FIG. 15A, the schematic illustration depicts the circumference view of the rotor 2 engaging the sleeve 44 in a raised position since the jagged saw-tooth guide profiles are not engaged. The surface 36 of the rotor 4 is contacting the surface 62 of the sleeve 44. Notice the gap between the slope surface 30 of the rotor 4 and the slope surface 64 of the sleeve 44. Flow will occur through the internal portion 5 of the rotor 2, as previously described. The rotor 2 moves reverse to the direction of the flow of the flow stream when moving in rotary motion. FIG. 15B depicts the rotor 2 and sleeve 44 of FIG. 15A in a lowered position since the jagged saw-tooth guide profiles are engaged. Hence, the surface 36 of the rotor 2 has been allowed to clear surface 62 of the sleeve 44 thereby lowering rotor 4. The slope surface 30 of the rotor 2 is now next to the sloped surface 64 of the sleeve 44. The rotor 2 moves in the same direction of the flow of the flow stream when moving in linear motion.

Figure 16:
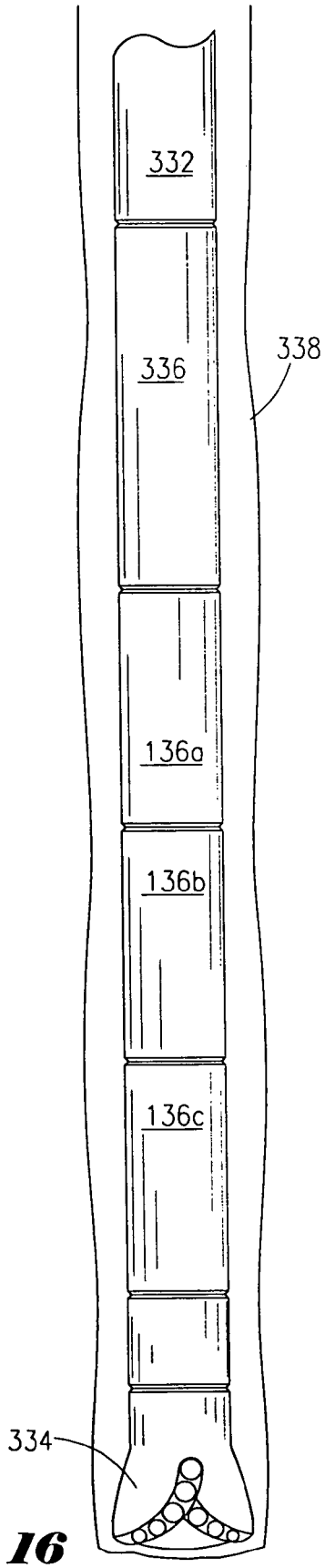
FIG. 16 is a schematic illustration of the percussion sub positioned within a drill sting.

FIG. 16 is a schematic illustration of the percussion sub positioned within a drill sting 332 having a bit 334. As can be seen, the percussion subs 136*a*, 136*b*, 136*c* can be placed in more than one position in the drill string 332. Additionally, the percussion subs 136*a,b,c* can be used with a motor turbine tool 336 in the drilling of a well bore 338. The percussion sub of the present invention can also be used with other tools, such as rotary steerable tools. In fact, the present apparatus may be added to most work strings any time a percussion effect is needed. It should be noted that the percussion sub of the present invention can be utilized as a component of different systems wherein a percussion and/or hammer effect is required. The percussion sub can be used in any surface or subsurface tool string, to clean out tubulars, as an impact hammer, as a vibration tool, as a cementing tool, as a compacting tool, etc.

Figure 17A:
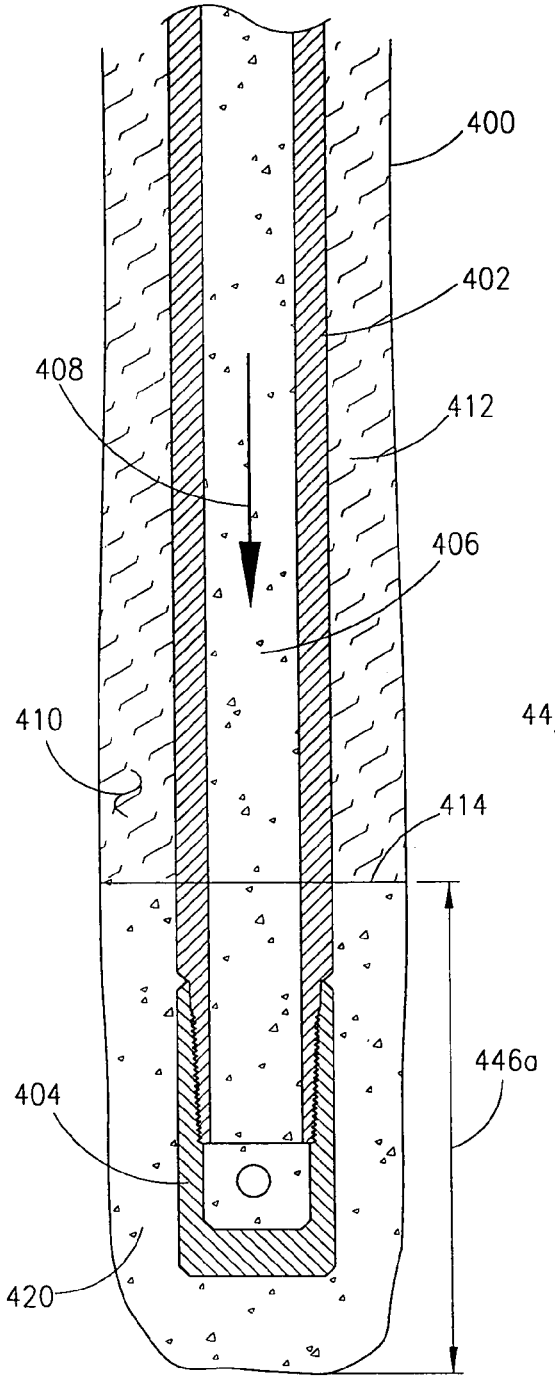
FIG. 17A is schematic illustration of a prior art cementing technique.

In yet another embodiment disclosed with the teachings of this invention, FIG. 17A depicts a schematic representation of the prior art technique used for cementing a casing string within a well bore. As those of ordinary skill in the art will appreciate, a well bore 400 is drilled. A casing string 402 is placed within the well bore 400. The bore hole wall of the well bore 400 has an exposed formation face. A cementing shoe 404 is contained on the end of casing 402. A cementing shoe 404 is commercially available from Halliburton Energy Services under the name Cementing Shoe or Casing Shoe, and is usually constructed of a drillable material such as aluminum.

Cement is generally pumped down the inner portion of the casing 402. The cement slurry in the casing is designated by the number 406, and is schematically shown. The cement is pumped down casing 402 in the direction of flow arrow 408, through the cement shoe 404, and out into the annulus area 410.

As those of ordinary skill in the art will recognize, the drilling fluid, denoted by the number 412, was already in place within the inner diameter of the casing 402 and the annulus area 410 before placement of the cement. The cement within the annulus area 410 is denoted by the numeral 420. Therefore, as the cement is pumped down the inner portion of the casing 402, and up annulus 410, the drilling fluid 412 will be displaced, as is readily understood by those of ordinary skill in the art. The pumping of the cement continues until all of the cement has been pumped down the inner portion of casing 402, and the annulus area 410 is completely filled with cement. The cement then is allowed to harden, thereby fixing the casing string 402 within the well bore 400.

Figure 17B:
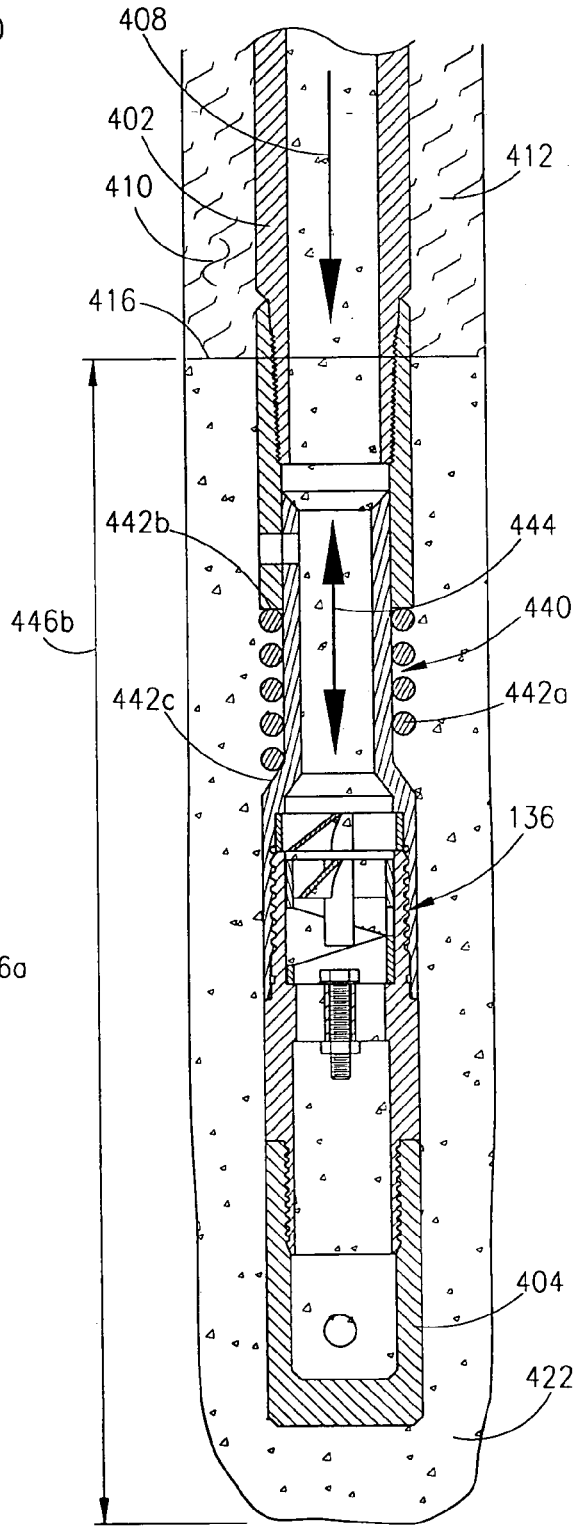
FIG. 17B is a schematic illustration of another preferred percussion sub embodiment.

Referring now to FIG. 17B, the cementing technique shown in FIG. 17A now contains a percussion tool, such as seen in FIGS. 6A and 6B and denoted as 136. The percussion tool 136 is placed above the cementing shoe 404 in casing 402. A shock module 440 is positioned between the percussion tool 136 and the casing 402. The shock module 440 has build-in compression and tension systems like spring means 442*a* or arrangements of similar means. The spring means 442*a* can be a tension type of coil spring having a first end abutting shoulder 442*b* and a second end abutting shoulder 442*c*. In one embodiment, the shock module 440 is threadedly connected to the percussion tool 136 at one end, and at the other end, the shock module 440 is connected to casing 402 via splined means.

The shock module 440 lets the percussion tool 136 and the cementing shoe 404 concurrently move in an axial direction up and an axial direction down the well bore 400 relative to the casing 402, hence, ensuring the axial vibration (shown by arrow 444) of the percussion tool 136. In an embodiment not shown, the shock module 440 can be an integrated member of the percussion tool 136 itself. As seen in FIG. 17B, the disclosed shock module 440 enhances the effect and the efficiency of the desired invention; however, the inclusion of the shock module 440 is not necessary to practice the invention herein disclosed.

As cement is pumped in the flow direction of 408 down the inner diameter of casing 402, the cement will be flowed through the percussion tool 136. The pumping of the cement slurry will cause the percussion tool 136 to vibrate in an oscillating manner 444, as previously described. The cement slurry will be subjected to the rotor blades of percussion tool 136. Additionally, the rotor of the percussion tool 136 will travel in a first longitudinal direction, followed by a second longitudinal direction, all as previously described. The cement slurry exiting the percussion tool 136 will enter the cement shoe 404. The slurry will then exit the cement shoe 404 and will travel into the annulus area 410, displacing the drilling fluid 412.

In the prior art pumping of cement (such as seen in FIG. 17A), as the cement is pumped downhole, it is subjected to a static movement (pure static pressure). As those of ordinary skill in the art will recognize, problems occur due to imperfectly sealed formation-casing interfaces. Thus, remedial works, such as squeeze jobs, must be performed in order to insure a proper placement of cement in the annulus area, as well as to insure proper bonding of the cement to the outer diameter of the casing.

As per the teachings of this new invention, the percussion tool 136 is placed above the cementing shoe 404 and the cement slurry can be pumped through the rotor and stator blades as other drilling slurries. Part of the hydraulic horsepower of the cement flow, which is being pumped, will be transformed into mechanical horsepower in the sense that the cement slurry becomes a vibrating mass column in the well bore. This vibration of the slurry reduces the friction between the cement particles itself, between the cement particles and the formation, and between the cement particles and the casing. This is a dynamic phase which is accomplished because of the percussion tool 136, and differs from the prior art static movement of the cement slurry. This dynamic phase allows the cement slurry to flow more easily into formation voids, pore cracks, fissures, etc.

Additionally, because the percussion tool 136 is vibrating the cement column, the cement particles have better settling. This will trigger fewer voids (porosity) in the annulus, therefore providing a much better sealing effect between cement particles, which in turn allows for better sealing effect between casing and formation, and casing and cement. Another advantage is that, since there is less porosity, there is higher density, which amounts to a better seal in the porous space of a formation. Additionally, with the teachings of the embodiment of FIG. 17B, there is reduced friction, hence less pressure column, therefore allowing for a higher cement column behind the casing with an equal amount of applied static pressure. For instance, see the cement column in FIG. 17A denoted by the numeral 414, and the cement column denoted by the numeral 416 in FIG. 17B. Hence, because of the reduced friction, the same amount of pumping pressure will allow for a higher displacement shown as the difference between the distance of line 446*b* of FIG. 17B and line 446*a* of FIG. 17A into the annular area 410. To put it another way, single line static pressure (cement pumps from the surface) will push the cement higher into the annulus behind the casing due to less pressure resistance when use of the percussion tool 136 is included. The difference of cement column height in the annulus 410 can also be explained with an enhanced efficiency of dynamic pressurized fluid in comparison with static pressurized fluids.

Actually, twice the percussion tool 136 and the shock module 440 will actuate the cement column. First, the rotor of the percussion tool 136 will vibrate the cement column itself. The cement column starts to pulsate. Second, the percussion tool 136 and cementing shoe 404 oscillate due to the axial movement enabled by the shock module 440, thus they by themselves as a whole will activate the cement slurry once more.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. A method of cementing a casing string within a well bore, said casing string forming an annulus within the well bore, the method comprising:

providing a device at the end of the casing string, the device comprising: a first member having an internal bore, said internal bore having a first profile, and wherein said first member contains an anvil face; a second member disposed within the internal bore, said second member having a second profile thereon, and wherein said second member contains a hammer face;

flowing a cement slurry through the first member and the second member;

vibrating the cement slurry, wherein the step of vibrating the cement slurry includes:

rotating the second member by flowing the cement slurry there through;

engaging the first profile with the second profile so that the second member travels in a direction opposite the flow of the cement slurry;

continuing to rotate the second member by flowing the cement slurry there through;

engaging the first profile with the second profile so that the second member travels in a same direction as the flow of the cement slurry;

flowing the cement slurry through the internal bore of the second member; and flowing the vibrating cement slurry out of a cementing shoe attached to the end of the casing string and into the annulus.

2. The method of claim 1 wherein the step of vibrating the cement column further includes:

engaging the first profile with the second profile so that the second member rotates and travels up in the direction opposite flow of the cement slurry;

continuing to rotate the second member;

continuing to engage the first profile with the second profile so that the second member travels down without rotating in the same direction as the flow of the cement slurry so that the column of cement is vibrating.

3. The method of claim 2 wherein said second member is a rotor means.

4. An apparatus for vibrating a cement slurry within a well bore, with the well bore having a concentric work string therein, the tool comprising:

a first member attached to a cementing shoe, the cementing shoe being disposed at an end of the work string, and wherein said first member has an anvil face and a first profile thereon;

a rotor disposed within the said first member, said rotor having a second profile, and wherein said rotor contains a hammer face, and wherein said rotor being disposed to receive the cement slurry pumped down an inner portion of the work string and wherein said rotor contains a plurality of blades disposed about a center core and wherein said blades turn responsive to the cement slurry flowing there through;

wherein said first profile cooperates with said second profile in a first position so that said hammer face contacts said anvil face;

wherein said first profile cooperates with said second profile in a second position so that said hammer face is separated from said anvil face so that the cement slurry is vibrated.

5. The apparatus of claim 4 further comprising a stator positioned to direct the cement slurry into the blades of said rotor.

6. The apparatus of claim 4 wherein said blades are disposed at an angle of inclination to optimize the transition from hydraulic horsepower of the cement slurry to the mechanical horsepower of the vibrating rotor.

7. The apparatus of claim 4 further comprising:

shock module means, positioned above the first member.

8. The apparatus of claim 7 wherein said shock module means consist of a sub having a spring means disposed about the sub, the sub having a first end connected to the first member and a second end connected to the work string.

9. The apparatus of claim 8 wherein said rotor contains a plurality of blades disposed about a center core and wherein said blades turn in responsive to the cement slurry flowing there through.

10. The apparatus of claim 9 wherein said spring means is a coiled tension spring.

11. The apparatus of claim 10 wherein said blades are disposed at an angle of inclination of forty-five degrees.

* * * * *